US010221030B2

(12) United States Patent
Koizumi

(10) Patent No.: US 10,221,030 B2
(45) Date of Patent: Mar. 5, 2019

(54) SHEET CONVEYING APPARATUS AND IMAGE FORMING APPARATUS

(71) Applicant: CANON KABUSHIKI KAISHA, Tokyo (JP)

(72) Inventor: Takuma Koizumi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/833,926

(22) Filed: Dec. 6, 2017

(65) Prior Publication Data

US 2018/0162673 A1 Jun. 14, 2018

(30) Foreign Application Priority Data

Dec. 13, 2016 (JP) ..... 2016-241331

(51) Int. Cl.
*B65H 29/12* (2006.01)
*G03G 15/00* (2006.01)
(Continued)

(52) U.S. Cl.
CPC ..... *B65H 29/125* (2013.01); *B65H 5/06* (2013.01); *B65H 5/062* (2013.01); *B65H 9/00* (2013.01); *B65H 9/004* (2013.01); *B65H 9/006* (2013.01); *B65H 9/008* (2013.01); *B65H 9/14* (2013.01); *G03G 15/6511* (2013.01); *B65H 1/04* (2013.01); *B65H 3/06* (2013.01); *B65H 2404/144* (2013.01); *B65H 2404/1424* (2013.01); *B65H 2801/03* (2013.01)

(58) Field of Classification Search
CPC ..... B65H 5/062; B65H 9/004; B65H 9/006; B65H 9/008; B65H 9/14; B65H 2404/1424; B65H 2404/1414; B65H 2404/1411
See application file for complete search history.

(56) References Cited

U.S. PATENT DOCUMENTS 4,974,680 A * 12/1990 Nishida ..... B41J 13/025 271/109
5,335,904 A * 8/1994 Ryuzaki ..... B65H 5/062 271/236

(Continued)

FOREIGN PATENT DOCUMENTS

JP 06115767 A * 4/1994 ..... B65H 9/006
JP 2003118890 A * 4/2003
JP 2013230880 A 11/2013

*Primary Examiner* — Luis A Gonzalez
(74) *Attorney, Agent, or Firm* — Canon U.S.A., Inc. IP Division

(57) ABSTRACT

A sheet conveying apparatus includes first and second roller members fixed to a rotatable shaft, a first follower roller that cooperates with the first roller member to form a conveying nip, and a second follower roller that cooperates with the second roller member to form a conveying nip. The first and second roller members have outer periphery cut-away parts and the first and second follower rollers are moveably supported and can be biased to home positions. If the first roller member cut-away part faces the first follower roller, the first follower roller is biased to move toward a home position while the nip of the second roller member nips and conveys a sheet. If the second roller member cut-away part faces the second follower roller, the second follower roller is biased to move toward a home position while the nip of the first roller member nips and conveys a sheet.

9 Claims, 3 Drawing Sheets

(51) Int. Cl.

| | |
|---|---|
| ***B65H 5/06*** | (2006.01) |
| ***B65H 9/00*** | (2006.01) |
| ***B65H 9/14*** | (2006.01) |
| *B65H 3/06* | (2006.01) |
| *B65H 1/04* | (2006.01) |

(56) References Cited

U.S. PATENT DOCUMENTS 5,362,041 A * 11/1994 Ryuzaki ..... B65H 9/006
226/19
5,683,078 A * 11/1997 Schieck ..... B65H 9/002
271/250
5,813,782 A * 9/1998 Mason ..... B41J 11/706
101/232
7,147,222 B2 * 12/2006 Christensen ..... B65H 7/06
271/228
7,416,182 B2 * 8/2008 Nishida ..... B65H 9/166
271/227
7,857,308 B2 * 12/2010 Nakazawa ..... B65H 9/002
271/228
8,036,588 B2 * 10/2011 Ishida ..... G03G 15/6567
271/228
8,820,738 B2 * 9/2014 Deno ..... B65H 9/00
271/228

* cited by examiner

SHEET CONVEYING APPARATUS AND IMAGE FORMING APPARATUS

BACKGROUND OF THE INVENTION

Field of the Invention

The present disclosure relates to a sheet conveying apparatus that conveys a sheet and an image forming apparatus provided with the sheet conveying apparatus.

Description of the Related Art

There is a sheet conveying apparatus that includes a roller for conveying a sheet where the roller is movable in a width direction perpendicular to a sheet conveying direction (refer to Japanese Patent Laid-Open No. 2013-230880). The roller moves in the width direction so as to shift from a home position by a force received from a conveyed sheet during the conveyance of the sheet. After a trailing end of the sheet passes the roller, the roller returns to the home position by a biasing unit.

After the trailing end of the sheet passes the roller, it is necessary to return the roller to the home position by a biasing force of the biasing unit before a leading end of the next sheet reaches the roller. Thus, when the distance between the sheets (the distance between the preceding sheet and the following sheet) is reduced, a sufficient time for returning the roller to the home position cannot be ensured. Therefore, conventional techniques cannot achieve high productivity of sheet conveyance.

SUMMARY OF THE INVENTION

In an embodiment, there is provided a sheet conveying apparatus that is provided with a roller movable in the width direction and capable of conveying sheets with high productivity.

According to an aspect of the present invention, a sheet conveying apparatus includes a shaft configured to rotate by transmission of driving force, a first roller member fixed to the shaft, a second roller member fixed to the shaft, a first follower roller configured to follow the first roller member, and to nip and convey a sheet with the first roller member, a second follower roller configured to follow the second roller member, and to nip and convey a sheet with the second roller member, a support unit configured to movably support the first follower roller and the second follower roller in a width direction of a sheet perpendicular to a sheet conveying direction, a first biasing unit configured to bias the first follower roller to a first home position in the width direction, a second biasing unit configured to bias the second follower roller to a second home position in the width direction, a first cut-away part formed on an outer periphery of the first roller member, and a second cut-away part formed on an outer periphery of the second roller member, wherein, in a state where the first cut-away part of the first roller member faces the first follower roller, the first follower roller is moved toward the first home position by the first biasing unit while a sheet is nipped and conveyed by the second roller member and the second follower roller, and wherein, in a state where the second cut-away part of the second roller member faces the second follower roller, the second follower roller is moved toward the second home position by the second biasing unit while a sheet is nipped and conveyed by the first roller member and the first follower roller.

Further features of the present invention will become apparent from the following description of embodiments (with reference to the attached drawings).

DESCRIPTION OF THE EMBODIMENTS

Hereinbelow, an embodiment will be described with reference to the drawings.

Figure 1:
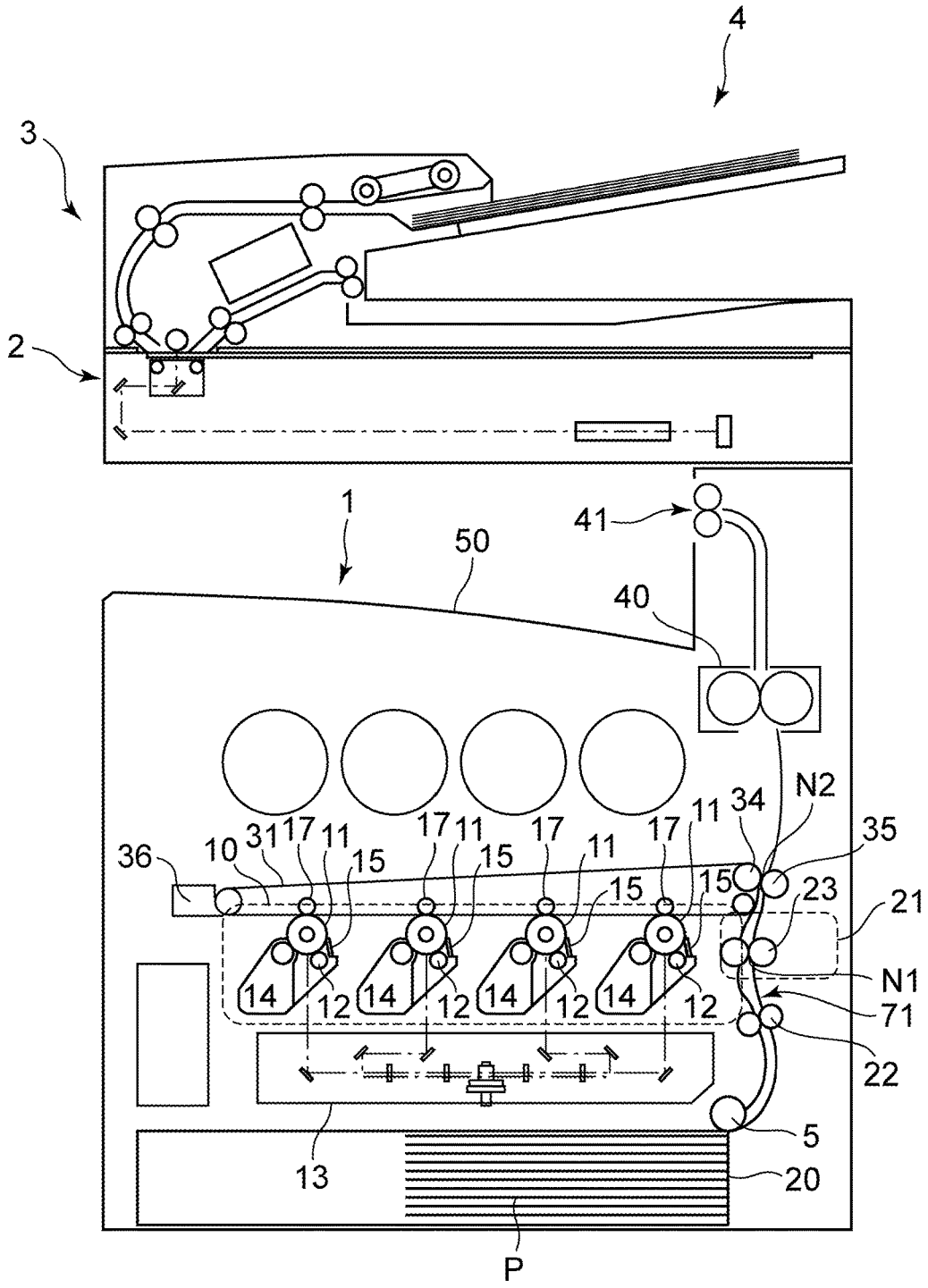
FIG. 1 is a sectional view illustrating the configuration of an image forming apparatus.

An image forming apparatus 4 illustrated in FIG. 1 includes a sheet conveying apparatus which conveys a sheet and forms an image on the conveyed sheet. The image forming apparatus 4 is provided with a print unit 1 which includes an image forming unit which forms an image on a sheet P, an image reading unit 2 which is disposed above the print unit 1, and a document feeder unit 3 which is placed on the image reading unit 2.

The print unit 1 is provided with an image forming unit 10 for colors of yellow Y, magenta M, cyan C, and black Bk. The surface of a photosensitive drum 11 is uniformly changed by a charging roller 12 and then exposed to light by a laser scanner 13 which is driven on the basis of a signal of transferred image information, so that an electrostatic latent image is formed. The electrostatic latent image formed on the surface of the photosensitive drum 11 is visualized as a toner image by the supply of toner by a developing device 14 which serves as a developing unit.

The toner images formed on the surface of the photosensitive drum 11 are sequentially transferred to an intermediate transfer belt 31. The intermediate transfer belt 31 serves as an image carrier by the application of a predetermined pressing force and a predetermined electrostatic load bias voltage by a primary transfer roller 17 which serves as a primary transfer unit. After the transfer, toner remaining on the surface of the photosensitive drum 11 is removed and collected by a photosensitive drum cleaner 15, which serves as a cleaning unit, and gets ready for the next image formation again.

On the other hand, the sheets P stored inside a sheet cassette 20 are fed out of the sheet cassette 20 by a feed roller 5 and separated by a separation unit (not illustrated) so as to be fed one by one. Then, the sheet P is nipped and conveyed by a pair of conveyance rollers 22 which serves as a conveyance unit for conveying the sheet P. Then, the sheet P is conveyed with skew feeding thereof corrected by a pair of registration rollers 23. The pair of registration rollers 23 is disposed on the downstream side in a sheet conveying direction relative to the pair of conveyance rollers 22 to further convey the sheet P nipped and conveyed by the pair of conveyance rollers 22.

A leading end of the sheet P nipped and conveyed by the pair of conveyance rollers 22 comes into contact with a nip portion N1 (abutment portion) of the pair of registration rollers 23 of a registration unit 21 in a stopped or a counter-rotating state. The skew feeding of the sheet P is corrected by forming a loop on the sheet P by allowing the leading end of the sheet P to follow the nip portion N1. Then, the pair of registration rollers 23 is driven to rotate, so that the sheet P is nipped and conveyed by the pair of registration rollers 23.

The pair of registration rollers 23 conveys the sheet P to a position between the intermediate transfer belt 31 and an external secondary transfer roller 35, which serves as a secondary transfer unit, synchronously with the toner image on an outer peripheral surface of the intermediate transfer belt 31. A predetermined pressing force and a predetermined electrostatic load bias voltage are applied to the color toner image on the outer peripheral surface of the intermediate transfer belt 31 at a nip portion N2 between an internal secondary transfer roller 34 and the external secondary transfer roller 35. The internal secondary transfer roller 34 is disposed facing the external secondary transfer roller 35 on the inner peripheral surface side of the intermediate transfer belt 31. Accordingly, the toner image on the outer peripheral surface of the intermediate transfer belt 31 is transferred to the sheet P.

The internal secondary transfer roller 34 and the external secondary transfer roller 35 are disposed on the downstream side in the sheet conveying direction relative to the pair of registration rollers 23 and further convey the sheet P nipped and conveyed by the pair of registration rollers 23 to the downstream side.

After the transfer of the toner image on the outer peripheral surface of the intermediate transfer belt 31 to the sheet P, toner remaining on the outer peripheral surface of the intermediate transfer belt 31 is removed and collected by a belt cleaner 36, which serves as a cleaning unit, and gets ready for the next image formation again.

The toner image transferred onto the sheet P is fixed by the application of heat and pressure by a fixing device 40 which serves as a fixing unit. The sheet with the fixed image is discharged onto a discharge tray 50 by a pair of discharge rollers 41.

Next, the pair of conveyance rollers 22 will be described in detail with reference to FIGS. 2 and 3.

Figure 2:
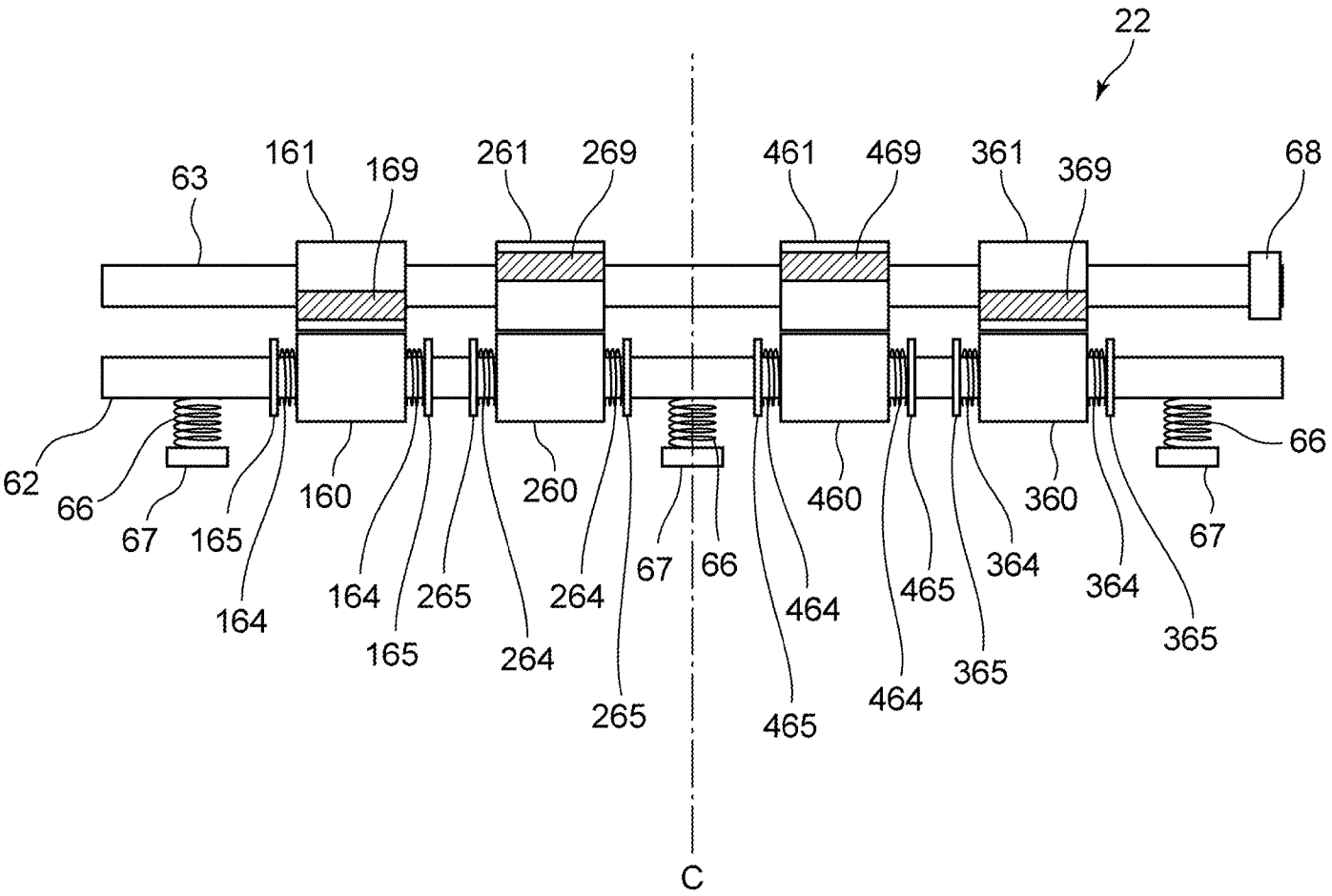
FIG. 2 is a diagram illustrating the configuration of a pair of conveyance rollers.
Figure 3:
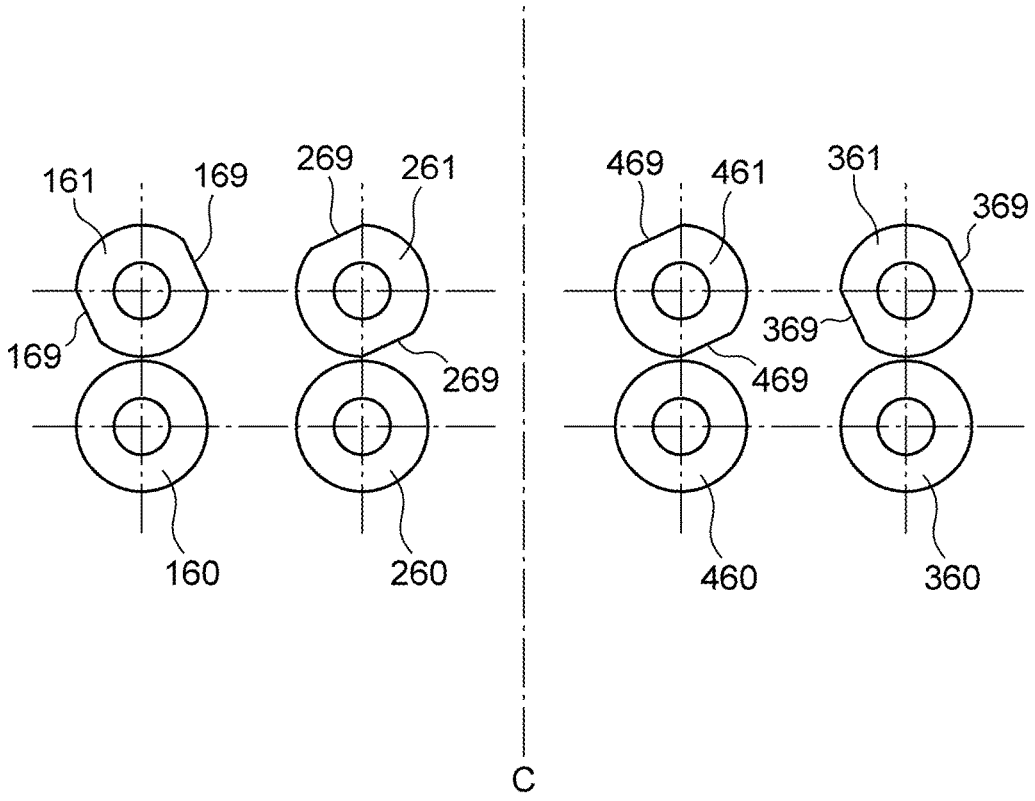
FIG. 3 is a sectional view illustrating the shape of the pair of conveyance rollers.

FIG. 2 is a diagram illustrating the configuration of the pair of conveyance rollers 22. The pair of conveyance rollers 22 is provided with a drive shaft 63 which rotates by a driving force transmitted from a motor (not illustrated) to a gear 68 and first to fourth roller members 161, 261, 361, 461 which are fixed to the drive shaft 63. The pair of conveyance rollers 22 is provided with first to fourth follower rollers 160, 260, 360, 460 which are respectively in contact with the outer peripheries of the first to fourth roller members 161, 261, 361, 461 and rotate following the first to fourth roller members 161, 261, 361, 461. The first to fourth follower rollers 160, 260, 360, 460 are supported on a follower roller shaft 62, which serves as a support unit, rotatably and movably in a width direction perpendicular to the sheet conveying direction.

The follower roller shaft 62 includes first spring abutment members 165 which are disposed on both sides of the first follower roller 160. First shift springs 164, which serve as a first biasing unit, are disposed between the first spring abutment members 165 and the first follower roller 160. The first shift springs 164 bias the first follower roller 160 to a first home position (neutral position) in the width direction.

The follower roller shaft 62 includes second spring abutment members 265 which are disposed on both sides of the second follower roller 260. Second shift springs 264, which serve as a second biasing unit, are disposed between the second spring abutment members 265 and the second follower roller 260. The second shift springs 264 bias the second follower roller 260 to a second home position in the width direction.

The follower roller shaft 62 includes third spring abutment members 365 which are disposed on both sides of the third follower roller 360. Third shift springs 364, which serve as a third biasing unit, are disposed between the third spring abutment members 365 and the third follower roller 360. The third shift springs 364 bias the third follower roller 360 to a third home position in the width direction.

The follower roller shaft 62 includes fourth spring abutment members 465 which are disposed on both sides of the fourth follower roller 460. Fourth shift springs 464, which serve as a fourth biasing unit, are disposed between the fourth spring abutment members 465 and the fourth follower roller 460. The fourth shift springs 464 bias the fourth follower roller 460 to a fourth home position in the width direction.

Pressure springs 66 abut against the follower roller shaft 62. The pressure springs 66 and pressure spring abutment members 67 are disposed at three positions: the front end; the center; and the rear end of the shaft. The first to fourth follower rollers 160, 260, 360, 460 are respectively biased toward the first to fourth roller members 161, 261, 361, 461 by biasing forces of the pressure springs 66. That is, the first to fourth follower rollers 160, 260, 360, 460 are supported on the follower roller shaft 62 in common. Thus, all the follower rollers 160, 260, 360, 460 are pressurized integrally with the follower roller shaft 62 to the first to fourth roller members 161, 261, 361, 461.

A first cut-away part 169 is formed on an outer peripheral surface of the first roller member 161 by cutting a part of the outer peripheral surface in the circumferential direction. A hatched area in FIG. 2 indicates the first cut-away part 169. In the present embodiment, two first cut-away parts 169 are formed on the first roller member 261 as illustrated in FIG. 3. The phases of the two first cut-away parts 169 in the circumferential direction are shifted from each other by 180°. In a state where the first cut-away part 169 faces the first follower roller 160, a gap is formed between the first roller member 161 and the first follower roller 160, so that the sheet is not nipped between the first roller member 161 and the first follower roller 160.

A second cut-away part 269 is formed on an outer peripheral surface of the second roller member 261 by cutting a part of the outer peripheral surface in the circumferential direction. In the present embodiment, two second cut-away parts 269 are formed on the second roller member 261. The phases of the two second cut-away parts 269 in the circumferential direction are shifted from each other by 180°. In a state where the second cut-away part 269 faces the second follower roller 260, a gap is formed between the second roller member 261 and the second follower roller 260, so that the sheet is not nipped between the second roller member 261 and the second follower roller 260.

A third cut-away part 369 is formed on an outer peripheral surface of the third roller member 361 by cutting a part of the outer peripheral surface in the circumferential direction. In the present embodiment, two third cut-away parts 369 are formed at positions of the same phases as the respective first cut-away parts 169. In a state where the third cut-away part 369 faces the third follower roller 360, a gap is formed between the third roller member 361 and the third follower roller 360, so that the sheet is not nipped between the third roller member 361 and the third follower roller 360.

A fourth cut-away part 469 is formed on an outer peripheral surface of the fourth roller member 461 by cutting a part of the outer peripheral surface in the circumferential direction. In the present embodiment, two fourth cut-away parts 469 are formed at positions of the same phases as the respective second cut-away parts 269. In a state where the fourth cut-away part 469 faces the fourth follower roller 460, a gap is formed between the fourth roller member 461 and the fourth follower roller 460, so that the sheet is not nipped between the fourth roller member 461 and the fourth follower roller 460.

When the first cut-away part 169 and the third cut-away part 369 face the first follower roller 160 and the third follower roller 360, respectively, the second cut-away part 269 and the fourth cut-away part 469 do not face the second follower roller 260 and the fourth follower roller 460. That is, the second cut-away part 269 and the fourth cut-away part 469 do not face the second follower roller 260 and the fourth follower roller 460, and the sheet can be nipped between the outer peripheral surface of the second roller member 261 and the outer peripheral surface of the second follower roller 260 and between the outer peripheral surface of the fourth roller member 461 and the outer peripheral surface of the fourth follower roller 460.

When the second cut-away part 269 and the fourth cut-away part 469 face the second follower roller 260 and the fourth follower roller 460, respectively, the first cut-away part 169 and the third cut-away part 369 do not face the first follower roller 160 and the third follower roller 360. That is, the first cut-away part 169 and the third cut-away part 369 do not face the first follower roller 160 and the third follower roller 360, and the sheet can be nipped between the outer peripheral surface of the first roller member 161 and the outer peripheral surface of the first follower roller 160 and between the outer peripheral surface of the third roller member 361 and the outer peripheral surface of the third follower roller 360.

That is, the first to fourth cut-away parts 169, 269, 369, 469 are disposed in such a manner that the sheet can be nipped by any of nip portions formed of the first to fourth roller members and the first to fourth follower rollers without depending on the position of the drive shaft 63 in a rotation direction.

Next, the operation and action of the pair of conveyance rollers 22 will be described.

When distortion occurs in a loop of the sheet P formed between the pair of registration rollers 23 and the pair of conveyance rollers 22, a distortion force of the sheet P exceeds the biasing force of each of the shift springs 164, 264, 364, 464. Accordingly, the first to fourth follower rollers 160, 260, 360, 460 move in the width direction against the biasing forces of the respective shift springs 164, 264, 364, 464. Thus, the distortion of the sheet P is reduced to below a predetermined level or eliminated, and a deterioration in the skew feeding accuracy of the sheet can be prevented.

When a rotation position of the drive shaft 63 is located at a position where the first and third cut-away parts 169, 369 face the first and third follower rollers 160, 360, respectively, the second and fourth roller members 261, 461 and the second and fourth follower rollers 260, 460 nip and convey the sheet. When the first and third cut-away parts 169, 369 are located at positions facing the first and third follower rollers 160, 360, respectively, there are gaps between the first roller member 161 and the first follower roller 160 and between the third roller member 361 and the third follower roller 360. Thus, the first follower roller 160 moves toward the first home position by the biasing force of the first shift spring 164, and the third follower roller 360 moves toward the third home position by the biasing force of the third shift spring 364.

When the rotation position of the drive shaft 63 is located at a position where the second and fourth cut-away parts 269, 469 face the second and fourth follower rollers 260, 460, respectively, the first and third roller members 161, 361 and the first and third follower rollers 160, 360 nip and convey the sheet. When the second and fourth cut-away parts 269, 469 are located at positions facing the second and fourth follower rollers 260, 460, respectively, there are gaps between the second roller member 261 and the second follower roller 260 and between the fourth roller member 461 and the fourth follower roller 460. Thus, the second follower roller 260 moves toward the second home position by the biasing force of the second shift spring 264, and the fourth follower roller 460 moves toward the fourth home position by the biasing force of the fourth shift spring 464.

As described above, the first to fourth cut-away parts 169, 269, 369, 469 are disposed in such a manner that the sheet can be nipped by any of the nip portions formed of the first to fourth roller members and the first to fourth follower rollers without depending on the rotation position of the drive shaft 63. Thus, the pair of conveyance rollers 22 can continuously convey the sheet P by constantly transmitting a conveyance force to the sheet P from the pair of conveyance rollers 22.

The first roller member 161 and the third roller member 361 are disposed at symmetric positions with respect to a conveyance center C of the sheet. Thus, when the sheet is fed only by the first roller member 161 and the third roller member 361, the conveyance force applied to the sheet P from the pair of conveyance rollers 22 becomes symmetric in the width direction with respect to the conveyance center C, which allows the sheet P to move straight. Thus, a deterioration in the sheet skew feeding when the sheet is conveyed by the first roller member 161 and the third roller member 361 is prevented. Similarly, the second roller member 261 and the fourth roller member 461 are disposed at symmetric positions with respect to the conveyance center C of the sheet. Thus, a deterioration in the sheet skew feeding when the sheet is conveyed by the second roller member 261 and the fourth roller member 461 is prevented.

As described above, it is possible to move (return) the first to fourth follower rollers 160, 260, 360, 460 to the respective home positions during the conveyance of the sheet by the pair of conveyance rollers 22. Thus, it is possible to reduce the distance between the preceding sheet and the following sheet which is fed following the preceding sheet. Thus, it is possible to refine the productivity of sheet conveyance.

As described above, the configuration of the embodiment makes it possible to reduce distortion to below a predetermined level or eliminate distortion of the sheet P that occurs between the pair of registration rollers 23 and the pair of conveyance rollers 22 and refine the productivity of sheet conveyance.

In the present embodiment described above, the pair of registration rollers 23 serves as the conveyance unit disposed on the downstream side of the pair of conveyance rollers 22, and the leading end of the sheet is brought into contact with the pair of registration rollers 23 to correct skew feeding of the sheet. Further, the first to fourth follower rollers 160, 260, 360, 460 move in the width direction by the distortion force in the loop of the sheet P generated between the pair of registration rollers 23 and the pair of conveyance rollers 22. Alternatively, the conveyance unit disposed on the downstream side of the pair of conveyance rollers 22 may be a shift roller that shifts (moves) in the width direction to move a nipped sheet in the width direction during the conveyance of the sheet by the pair of conveyance rollers 22. Also in this case, the first to fourth follower rollers 160, 260, 360, 460 move in the width direction by a force received from the sheet in the width direction with a shift of the sheet by the shift roller.

Although an electrophotographic type image forming unit has been described as an example of the image forming unit that forms an image on a sheet, the image forming unit may be an ink jet type image forming unit.

While the present invention has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2016-241331, filed Dec. 13, 2016, which is hereby incorporated by reference herein in its entirety.

What is claimed is:

1. A sheet conveying apparatus comprising:

a shaft configured to rotate by transmission of driving force;

a first roller member fixed to the shaft;

a second roller member fixed to the shaft;

a first follower roller configured to follow the first roller member, and to nip and convey a sheet with the first roller member;

a second follower roller configured to follow the second roller member, and to nip and convey a sheet with the second roller member;

a support unit configured to movably support the first follower roller and the second follower roller in a width direction of a sheet perpendicular to a sheet conveying direction;

a first biasing unit configured to bias the first follower roller to a first home position in the width direction;

a second biasing unit configured to bias the second follower roller to a second home position in the width direction;

a first cut-away part formed on a first outer periphery of the first roller member; and a second cut-away part formed on a second outer periphery of the second roller member, wherein, in a state where the first cut-away part of the first roller member faces the first follower roller, the first follower roller is moved toward the first home position by the first biasing unit while a sheet is nipped and conveyed by the second roller member and the second follower roller, wherein, in a state where the second cut-away part of the second roller member faces the second follower roller, the second follower roller is moved toward the second home position by the second biasing unit while a sheet is nipped and conveyed by the first roller member and the first follower roller, and wherein, in a cross section of the first roller member intersecting with a first rotating shaft of the first roller member, a distance from the first rotating shaft to the first cut-away part in the first outer periphery is shorter than a distance from the first rotating shaft to a first outer surface of a part other than the first cut-away part in the first outer periphery, and, in a cross section of the second roller member intersecting with a second rotating shaft of the second roller member, a distance from the second rotating shaft to the second cut-away part in the second outer periphery is shorter than a distance from the second rotating shaft to a first outer surface of a part other than the second cut-away part in the second outer periphery.

2. The sheet conveying apparatus according to claim 1, further comprising:

a third roller member fixed to the shaft; and a third follower roller movably supported in the width direction by the support unit, wherein the third follower roller is configured to follow the third roller member, and to nip and convey a sheet with the third roller member, wherein the third roller member is disposed at a position symmetric to the first roller member with respect to a conveyance center in the width direction and includes a third cut-away part formed in a phase that is the same as a phase of the first cut-away part of the first roller member.

3. The sheet conveying apparatus according to claim 2, further comprising:

a fourth roller member fixed to the shaft; and a fourth follower roller movably supported in the width direction by the support unit, wherein the fourth follower roller is configured to follow the fourth roller member, and to nip and convey a sheet with the fourth roller member, wherein the fourth roller member is disposed at a position symmetric to the second roller member with respect to the conveyance center in the width direction and includes a fourth cut-away part formed in a phase that is the same as a phase of the second cut-away part of the second roller member.

4. The sheet conveying apparatus according to claim 1, further comprising an abutment portion configured to make contact with a leading end of a sheet conveyed by the first roller member and the second roller member.

5. The sheet conveying apparatus according to claim 4, wherein the abutment portion is a pair of registration rollers.

6. The sheet conveying apparatus according to claim 1, further comprising a shift roller configured to shift a sheet conveyed by the first roller member and the second roller member in the width direction.

7. An image forming apparatus comprising:

a shaft configured to rotate by transmission of driving force;

a first roller member fixed to the shaft;

a second roller member fixed to the shaft;

a first follower roller configured to follow the first roller member, and to nip and convey a sheet with the first roller member;

a second follower roller configured to follow the second roller member, and to nip and convey a sheet with the second roller member;

an image forming unit configured to form an image on a sheet conveyed by the first roller member, the first follower roller, the second roller member, and the second follower roller;

a support unit configured to movably support the first follower roller and the second follower roller in a width direction of a sheet perpendicular to a sheet conveying direction;

a first biasing unit configured to bias the first follower roller to a first home position in the width direction;

a second biasing unit configured to bias the second follower roller to a second home position in the width direction;

a first cut-away part formed on a first outer periphery of the first roller member; and a second cut-away part formed on a second outer periphery of the second roller member, wherein, in a state where the first cut-away part of the first roller member faces the first follower roller, the first follower roller is moved toward the first home position by the first biasing unit while a sheet is nipped and conveyed by the second roller member and the second follower roller, wherein, in a state where the second cut-away part of the second roller member faces the second follower roller, the second follower roller is moved toward the second home position by the second biasing unit while a sheet is nipped and conveyed by the first roller member and the first follower roller, and wherein, in a cross section of the first roller member intersecting with a first rotating shaft of the first roller member, a distance from the first rotating shaft to the first cut-away part in the first outer periphery is shorter than a distance from the first rotating shaft to a first outer surface of a part other than the first cut-away part in the first outer periphery, and, in a cross section of the second roller member intersecting with a second rotating shaft of the second roller member, a distance from the second rotating shaft to the second cut-away part in the second outer periphery is shorter than a distance from the second rotating shaft to a first outer surface of a part other than the second cut-away part in the second outer periphery.

8. A sheet conveying apparatus comprising:

first and second drive portions configured to rotate by transmission of driving force;

a first follower roller configured to follow the first drive portion and to nip a sheet with the first drive portion;

a second follower roller configured to follow the second drive portion and to nip a sheet with the second drive portion; and a support unit configured to movably support the first follower roller and the second follower roller in a width direction of a sheet perpendicular to a sheet conveying direction, wherein the second follower roller is movable in the width direction without nipping a sheet with the second drive portion when the sheet nipped by the first drive portion and the first follower roller passes between the second follower roller and the second drive portion, and wherein the first follower roller is movable in the width direction without nipping a sheet with the first drive portion when the sheet is-nipped by the second drive portion and the second follower roller passes between the first follower roller and the first drive portion.

9. The sheet conveying apparatus according to claim 8, further comprising an abutment portion configured to make contact with a leading end of a sheet conveyed by the first and second drive portions.

* * * * *